United States Patent [19]

Holmes et al.

[11] 4,347,502

[45] Aug. 31, 1982

[54] EARLY WARNING ELECTRICAL SOUND ALARM SYSTEM FOR PET DOOR STRUCTURE

[75] Inventors: David L. Holmes, Westminster; Anne M. Hollander, Northridge, both of Calif.

[73] Assignee: Johnson Pet-Dor, Inc., Valencia, Calif.

[21] Appl. No.: 153,567

[22] Filed: May 27, 1980

[51] Int. Cl.[3] ..... G08B 13/08; G08B 13/14

[52] U.S. Cl. ..... 340/545; 119/1; 160/10; 200/61.74; 200/61.93; 340/546; 340/568

[58] Field of Search ..... 340/540, 546, 545, 547, 340/550, 568; 200/61.62, 61.73, 61.71, 61.74, 61.93; 119/1; 160/10, 354

[56] References Cited

U.S. PATENT DOCUMENTS

| | | | |
|---|---|---|---|
| 913,669 | 2/1909 | Munsell . | |
| 1,012,590 | 12/1911 | Bobo . | |
| 1,319,416 | 10/1919 | Pease | 340/545 X |
| 2,758,646 | 8/1956 | Johnson | 160/354 |
| 3,259,709 | 7/1966 | Hemmens | 200/65 |
| 3,567,882 | 3/1971 | Beck | 200/61.93 |
| 3,706,090 | 12/1972 | Callaghan | 340/547 |
| 3,768,087 | 10/1973 | Kaye et al. | 340/545 |

*Primary Examiner*—John W. Caldwell, Sr.
*Assistant Examiner*—Joseph E. Nowicki
*Attorney, Agent, or Firm*—Frank Frisenda, Jr.

[57] ABSTRACT

The present invention provides an early warning sound alarm system for signalling unauthorized entry or attempted entry through a pet door when the pet door is covered and not in use. The alarm system in accordance with the invention, comprises in combination: a pet door including a frame defining a passageway therethrough, and a flap swingably mounted on the frame adjacent the upper edge of the passageway for swinging movement in either direction therethrough; a covering member removably secured to one side of the frame adjacent the flap for preventing entry through the passageway; and an electrically powered sound alarm, including a sound signal box, and a switch such as a leaf spring biased limit switch disposed between the flap and the surface of covering member adjacent the flap. The switch is suitably positioned to maintain the sound signal box in a deactivated state when the covering member is secured on the frame to prevent entry through the passageway. In one embodiment, the sound signal box contains a trip switch which activates the sound alarm in the event a removably secured second covering member is moved or removed from the pet door frame.

16 Claims, 5 Drawing Figures

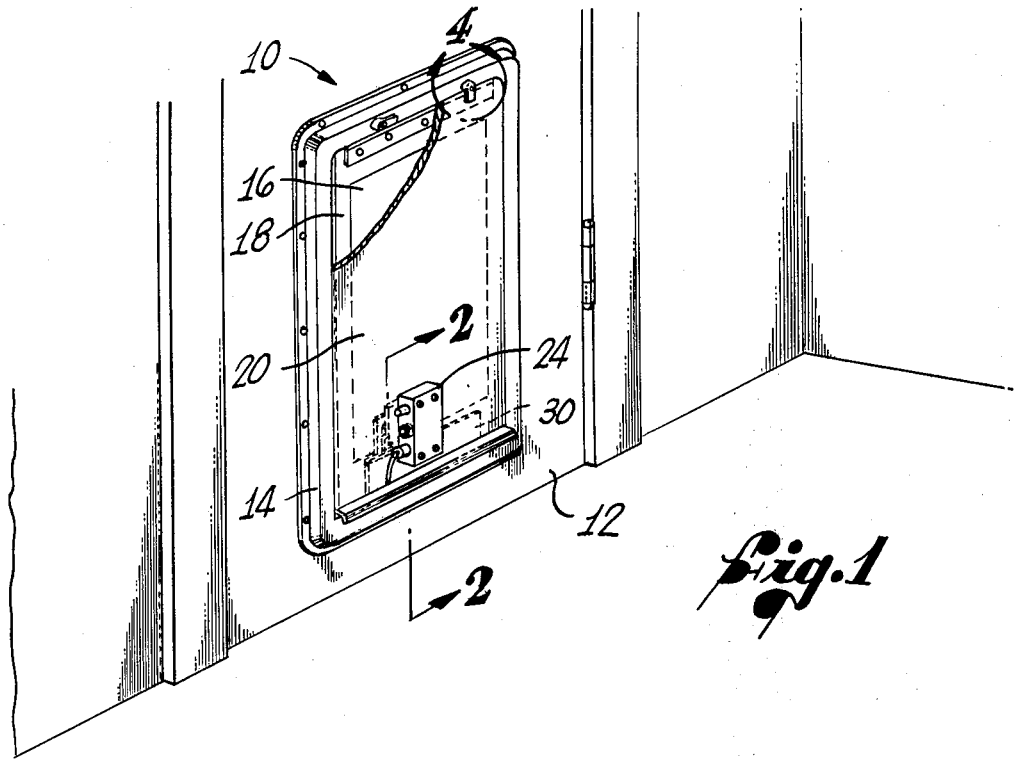
Fig. 1
Fig. 4
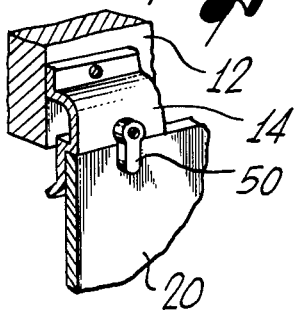
Fig. 2
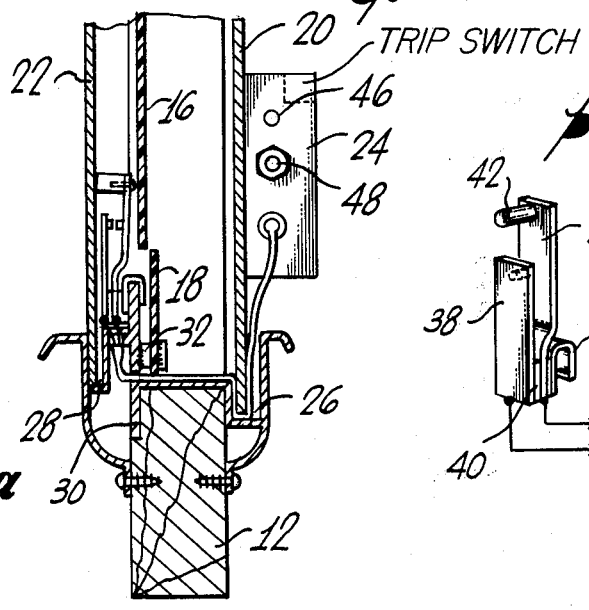
Fig. 3
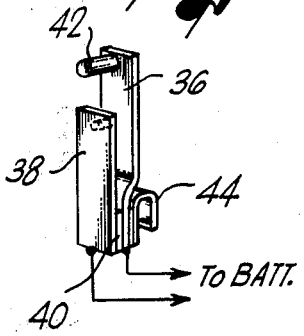
Fig. 2a
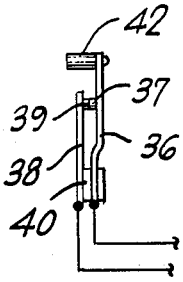

EARLY WARNING ELECTRICAL SOUND ALARM SYSTEM FOR PET DOOR STRUCTURE

BACKGROUND OF THE INVENTION

This invention relates to an early warning electrical sound alarm system for pet door structures to signal unauthorized entry or attempted entry through the pet door when the pet door is covered and not in use.

Pet doors adapted for the passage of small animals, such as dogs and cats, into the owners home have gained and continue to gain wide acceptance in the market place. For instance, an extremely successful pet door structure is disclosed in U.S. Pat. No. 2,758,646 issued to Johnson on Aug. 14, 1956. The Johnson pet door structure generally includes a frame defining a passageway therethrough, and a flap swingably mounted on the frame adjacent the upper edge of the passageway for swinging movement in either direction therethrough. Associated with the frame is a pair of interior and exterior solid panels which may be releasably secured on each side of the frame when the pet door is not in use.

To enhance security of the pet owner's home, a need has been expressed for an effective early warning system to signal unauthorized entry through the pet door, for instance by a prowler's hand attempting to reach the inside door knob. Further, it is desirable, if not necessary, to have a self-contained alarm system which may be quickly and easily installed on pet doors of various sizes. The present invention fulfills this need.

SUMMARY OF THE INVENTION

The present invention provides an early warning sound alarm system for signalling unauthorized entry or attempted entry through a pet door when the pet door is covered and not in use.

The alarm system in accordance with the invention, comprises in combination: a pet door including a frame defining a passageway therethrough, and a flap swingably mounted on the frame adjacent the upper edge of the passageway for swinging movement in either direction therethrough; a covering member removably secured to one side of the frame adjacent the flap for preventing entry through the passageway; and an electrically powered sound alarm, including a sound signal box, and switch means disposed between the flap and the surface of covering member adjacent the flap. The switch means is suitably positioned to maintain the sound signal box in a deactivated state when the covering member is secured on the frame to prevent entry through the passageway.

In a presently preferred embodiment, the switch means of the inventive electrical sound alarm system may generally be described as a leaf spring biased limit switch comprising a pair of electrically conductive elongated plates, each of the plates having a contact element on adjacent plate faces, the contact elements being normally engaged when the switch is in an activated state.

One of the elongated plates includes means for keeping the contact elements disengaged when a force opposing the switch leaf spring force is applied by securement of the covering member on the pet door frame.

The switch is preferably mounted on a portion of the pet door frame which is abutted when the covering member is secured in position to prevent entry through the passageway. The sound signal box is preferably mounted on the inside face of a second covering member for removable securement to the opposite side of the pet door frame.

In yet another preferred embodiment, the sound signal box contains a trip switch which activates the sound alarm in the event the secured second covering member is moved or removed from the pet door frame. Other features and advantages of the invention will become apparent from the following more detailed description, taken in conjunction with the accompanying drawings.

BRIEF DESCRIPTION OF THE DRAWINGS

FIG. 1 is a perspective view of a preferred embodied form of the instant invention illustrating a pet door with an interior covering member releasably secured to the pet door frame and further depicting a sound signal box of the electrical sound alarm system suitably positioned on the inside face of the interior covering member;

FIG. 2 is a cross-sectional fragmental side view of the lower portion of the pet door taken substantially along line 2—2 of FIG. 1;

FIG. 2A is a side view illustrating a preferred electrical switch for the sound alarm system of the present invention;

FIG. 3 is an enlarged perspective view of the electrical switch depicted in FIG. 2; and FIG. 4 is an enlarged fragmentary view of a swivel latch for releasably securing the covering member to the pet door frame.

DESCRIPTION OF THE PREFERRED EMBODIMENTS

Referring to FIG. 1, there is illustrated a pet door, generally denoted 10, mounted in a barrier such as a standard personnel door 12. The pet door 10 includes a frame 14 defining a passageway therethrough and a flap 16, disposed within and substantially filling the passageway, swingably mounted on the frame 14 adjacent the upper edge of the passageway for swinging movement in either direction therethrough. In this respect, the flap 16 is preferably composed of durable flexible material, for instance, a heavy rubber or plastic sheet. Optionally, the flap 16, as the one depicted, may be of two piece construction including a border 18 which is free to swing inwardly, but suitably constrained from outside swinging movement to block the passage of drafts. Associated with the frame 14 is an interior covering member 20 and an exterior covering member 22 which may be releasably secured to the frame 14 to block the passageway of the pet door when not in use.

As shown most clearly in FIG. 2, a sound alarm system is provided for signalling unauthorized entry through the pet door 10 when the exterior covering member 22 or both members 20 and 22 are secured in position on frame 14. The sound alarm comprises an electrically powered sound signal box 24, for instance, powered by a standard 9 volt battery contained within the box 24. The sound signal box 24 is suitably mounted on or near the pet door 10 such as shown, on the interior covering member 20. Around the bottom of the interior and exterior portions of the pet door frame 14, channel or groove members 26 and 28 are provided to receive the respective lower edges of interior and exterior covering members 20 and 22. Further, the lower portion of the pet door frame 14 includes an upstanding flat support 30 which acts as a stop for the border 18 but permits the flap 16 to swing freely. In one embodied form, the border 18 may preferably include a plurality of magnets 32 disposed on the lower edge of the border face adjacent the support 30 which is composed of a magnetically attractive material. Accordingly, the border 18 is releasably engaged by the magnetic force exerted by magnets 32 in a vertical position to block the passage of drafts, and in general keep the flap 16 closed over the passageway when covering members 20 and 22 are removed.

Illustrated in FIGS. 2, 2A and 3, is a preferred electrical switch 34 for the inventive sound signal alarm. The switch 34 may generally be described as a leaf spring biased limit switch comprising two resilient electrically conductive elongated plates 36 and 38, each of the plates having a contact element 37 and 39 on adjacent plate faces, the contact elements 37 and 39 being normally engaged when the switch is in an activated state. The elongated plate 36 includes means for keeping the contact elements 37 and 39 disengaged when a force opposing the switch leaf spring force is applied by securement of the covering member 22 on the pet door frame 14. In one embodied form, elongated plate 36 is relatively longer than plate 38 to provide protrusion of post 42 disposed on upper adjacent face of plate 36 past the top end of plate 38. As shown most clearly in FIG. 3, the lower portion of switch 34 further includes an insulated spacer 40 disposed between the plates 36 and 38, and a mounting bar 44 to provide for suitable mounting of the switch 34 in proximity to the inner surface of exterior covering member 22, such as on the upstanding flat support 30 of the pet door frame 14.

An effective circuit is formed by conventional electrical wiring suitably positioned from the sound signal box 24 to the switch 34. As illustrated in FIG. 2, the electrical wiring may be, for instance, positioned under the lower edge of interior covering member 20 to conform with the guide or channel member 26, passed under the border 18 and around a side edge of upstanding support 30 which is not completely co-extensive with the lower portion of the frame 14. Accordingly, when the exterior covering member 22 is releasably secured to the frame 14, the inside surface of the covering member 22 abuts the protruding switch post 42 causing separation of the plate contact elements 37 and 39 maintaining the switch 34 in a deactivated state. However, when the exterior covering member 22 is removed from the frame 14, for instance by a prowler, the inherent force exerted by the leaf spring biased limit switch 34 causes the contact elements 37 and 39 to engage, thus activating the sound signal box 24.

Additionally, the sound signal box 24 preferably is of solid-state circuitry and includes a master switch 46 for turning the alarm system on and off and a test button 48 to assure that the sound system is in working order. Further, a "deadman" or trip switch as shown in FIG. 2 may be preferably included in the sound signal box 24 to activate the sound alarm in the event the interior covering member 20 is removed.

FIG. 4 depicts a swivel latch 50 provided on the upper portion of frame 14 as a convenient means for releasable securement of interior and exterior covering members 20 and 22 to the pet door frame 14.

When the pet door 10 is in use, to allow free passage of a small animal such as a dog or cat through the passageway, the covering members 20 and 22 are removed from the frame 14 and placed to one side. To pass through the passageway, the animal steps through the passageway, and with his head he pushes aside or upwardly the flap 16 which faces him. When the animal's body has completely cleared the passageway, the flap 16 drops back into its original vertical position by virtue of its weight and natural resiliency. The flap 16 then resumes the position shown in FIG. 2. Further disclosure regarding a suitable pet door structure for use in association with the inventive alarm system described above may be found in U.S. Pat. No. 2,758,646, which is hereby incorporated by this reference.

Accordingly, the present invention provides an early warning system for signalling unauthorized entry or attempted entry through the pet door when the pet door is covered and not in use.

While the instant invention has been shown and described herein an a presently preferred embodiment, it is recognized that departures may be made from the preferred embodiment within the scope of the invention, which is therefore not to be limited to the details disclosed herein, but is to be accorded the full scope of the claims.

We claim:

1. A sound alarm system for signalling unauthorized entry through a pet door when the door is covered and not in use, said system comprising in combination:

a pet door including a frame defining a passageway therethrough, and a flap swingable mounted passageway for swinging movement in either direction therethrough; cover means removably secured to one side of said frame adjacent said flap for preventing entry through said passageway; and an electrically powered sound alarm for signalling removal of said cover means said alarm including a sound signal box, and switch means having an activated state and a deactivated state, said switch means disposed between said flap and said cover means and positioned to maintain said switch means in a deactivated state when said cover means is removably secured to said frame, and further comprising second interior cover means removably secured to the opposite side of said frame adjacent said flap for preventing entry through the passageway, wherein said sound signal box includes a trip switch means which activates the sound alarm in the event said second interior cover means is removed from said frame.

2. The sound alarm system as defined in claim 1 wherein said frame includes an upstanding support disposed in the bottom of said passageway and said switch means is mounted on said support.

3. The sound alarm system as defined in claim 1 wherein said switch means is a leaf spring biased limit switch.

4. The sound alarm system as defined in claim 3 wherein said switch comprises: first and second resilient electrically conductive elongated plates with spaced adjacent faces, each of said plates having a contact element disposed on said adjacent face, said contact elements being normally engaged when said switch is in the activated state, and one of said plates having means for keeping said contact elements disengaged when said covering member is secured on said frame.

5. The sound alarm system as defined in claim 4 wherein said means for keeping said contact elements disengaged comprises a post disposed on an upper portion of said adjacent face of said first elongated plate, said post being of sufficient length to protrude past the top end of the non-adjacent face of said second elongated plate when said contact elements are engaged.

6. The sound alarm system as defined in claim 4 wherein said switch further comprises means for mounting said switch to an upstanding support disposed in the bottom of said frame.

7. The sound alarm system as defined in claim 1 wherein said sound signal box is mounted on a surface of said second cover means which is non-adjacent said flap.

8. The sound alarm system as defined in claim 1 wherein said sound signal box is of solid state circuitry.

9. A sound alarm system for signalling unauthorized entry through a pet door when the door is covered and not in use, said system comprising in combination:

a pet door including a frame defining a passageway therethrough, and a flap swingably mounted on said frame adjacent the upper edge of said passageway for swinging movement in either direction therethrough; exterior cover means removably secured to one side of said frame adjacent said flap for preventing entry through said passageway; and an electrically powered sound alarm for signalling removal of said cover means said alarm including a sound signal box, and switch means having an activated state and a deactivated state, said switch means being remote from said sound signal box and disposed between said flap and said cover means and positioned to maintain said switch in a deactivated state when said cover means is removably secured to said frame, and further comprising second interior cover means removably secured to the opposite side of said frame adjacent said flap for preventing entry through said passageway; said sound signal box being disposed on a surface of said second cover means which is non-adjacent said flap, wherein said sound alarm system including said switch means and said sound signal box are concealed from sight when viewing the pet door from the outside surface of said exterior cover means.

10. The sound alarm system as defined in claim 9 wherein said frame includes an upstanding support disposed in the bottom of said passageway and said switch means is mounted on said support.

11. The sound alarm system as defined in claim 9 wherein said switch means is a leaf spring biased limit switch.

12. The sound alarm system as defined in claim 11 wherein said switch means comprises first and second resilient electrically conductive elongated plates with spaced adjacent faces, each of said plates having a contact element disposed on said adjacent face, said contact elements being normally engaged when said switch is in the activated state, and one of said plates having means for keeping said contact elements disengaged when said covering member is secured on said frame.

13. The sound alarm system as defined in claim 12 wherein said means for keeping said contact elements disengaged comprises a post disposed on an upper portion of said adjacent face of said first elongated plate, said post being of sufficient length to protrude past the top end of the non-adjacent face of said second elongated plate when said contact elements are engaged.

14. The sound alarm system as defined in claim 12 wherein said switch further comprises means for mounting said switch to an upstanding support disposed in the bottom of said frame.

15. The sound alarm system as defined in claim 9 wherein said sound signal box includes a trip switch means which activates the sound alarm in the event said second cover means is removed from said frame.

16. The sound alarm system as defined in claim 9 wherein said sound signal box is of solid state circuitry.

* * * * *